US010099277B2

(12) United States Patent
Jones et al.

(10) Patent No.: US 10,099,277 B2
(45) Date of Patent: Oct. 16, 2018

(54) CORE FOR AN INVESTMENT CASTING PROCESS

(71) Applicant: ROLLS-ROYCE PLC, London (GB)

(72) Inventors: Simon Lloyd Jones, Bristol (GB); Mark John Simms, Bristol (GB)

(73) Assignee: ROLLS-ROYCE plc, London (GB)

( * ) Notice: Subject to any disclaimer, the term of this patent is extended or adjusted under 35 U.S.C. 154(b) by 220 days.

(21) Appl. No.: 15/050,633

(22) Filed: Feb. 23, 2016

(65) Prior Publication Data

US 2016/0256919 A1 Sep. 8, 2016

(30) Foreign Application Priority Data

Mar. 4, 2015 (GB) ..... 1503640.3

(51) Int. Cl.

| | |
|---|---|
| ***B22C 9/10*** | (2006.01) |
| ***B22C 21/14*** | (2006.01) |
| ***B22C 9/24*** | (2006.01) |
| ***B22C 7/02*** | (2006.01) |

(52) U.S. Cl.

CPC ..... *B22C 9/24* (2013.01); *B22C 7/02* (2013.01); *B22C 9/10* (2013.01); *B22C 21/14* (2013.01)

(58) Field of Classification Search

CPC .... B22C 7/02; B22C 9/10; B22C 9/24; B22C 21/14

See application file for complete search history.

(56) References Cited

U.S. PATENT DOCUMENTS

| | | | | |
|---|---|---|---|---|
| 4,596,281 | A * | 6/1986 | Bishop | B22C 9/10 164/122.1 |
| 5,947,181 | A * | 9/1999 | Davis | B22C 9/106 164/131 |
| 6,340,047 | B1 * | 1/2002 | Frey | B22C 21/14 164/122.1 |
| 9,765,630 | B2 * | 9/2017 | Herzlinger | F01D 5/187 |
| 2008/0145234 | A1 | 6/2008 | Lee et al. | |
| 2011/0180227 | A1 | 7/2011 | Anglin | |
| 2014/0341724 | A1 | 11/2014 | Weber et al. | |

FOREIGN PATENT DOCUMENTS

| | | | |
|---|---|---|---|
| EP | 1240959 | A2 | 9/2002 |
| GB | 2352418 | A | 1/2001 |
| WO | 2004/033128 | A2 | 4/2004 |

OTHER PUBLICATIONS

May 22, 2015 Search Report issued in British Patent Application No. GB1503640.3.

Jul. 13, 2016 Search Report issued in European Patent Application No. 16156731.

* cited by examiner

*Primary Examiner* — Kevin E Yoon

(74) *Attorney, Agent, or Firm* — Oliff PLC

(57) ABSTRACT

There is described a core for an investment casting process, comprising: a core passage which extends between a first point and a second point along a tortuous path having length L, wherein the first point and second point are separated by a direct line of sight distance, S, wherein L is greater than S; and, a core bridge which extends between the first and second points away from the core passage.

12 Claims, 4 Drawing Sheets

CORE FOR AN INVESTMENT CASTING PROCESS

TECHNICAL FIELD OF INVENTION

The present invention relates to an improved method of providing core stability for cores of an investment casting process. In particular, the invention relates to an investment casting core for a component having internal passages which require high precision positioning.

BACKGROUND OF INVENTION

FIG. 1 shows a ducted fan gas turbine engine 10 comprising, in axial flow series: an air intake 12, a propulsive fan 14 having a plurality of fan blades 16, an intermediate pressure compressor 18, a high-pressure compressor 20, a combustor 22, a high-pressure turbine 24, an intermediate pressure turbine 26, a low-pressure turbine 28 and a core exhaust nozzle 30. The fan, compressors and turbine are all rotatable about a principal axis 31 of the engine 10. A nacelle 32 generally surrounds the engine 10 and defines the intake 12, a bypass duct 34 and a bypass exhaust nozzle 36.

Air entering the intake 12 is accelerated by the fan 14 to produce a bypass flow and a core flow. The bypass flow travels down the bypass duct 34 and exits the bypass exhaust nozzle 36 to provide the majority of the propulsive thrust produced by the engine 10. The core flow enters in axial flow series the intermediate pressure compressor 18, high pressure compressor 20 and the combustor 22, where fuel is added to the compressed air and the mixture burnt. The hot combustion products expand through and drive the high, intermediate and low-pressure turbines 24, 26, 28 before being exhausted through the nozzle 30 to provide additional propulsive thrust. The high, intermediate and low-pressure turbines 24, 26, 28 respectively drive the high and intermediate pressure compressors 20, 18 and the fan 14 by interconnecting shafts 38, 40, 42.

The performance of gas turbine engines, whether measured in terms of efficiency or specific output, is generally improved by increasing the turbine gas temperature. It is therefore desirable to operate the turbines at the highest possible temperatures. As a result, the turbines in state of the art engines, particularly high pressure turbines, operate at temperatures which are greater than the melting point of the material of the blades and vanes making some form cooling necessary.

Typically, components are cooled by a flow of compressed air which is at a higher pressure than the main gas path but a significantly lower temperature. Components are provided with internal cooling passages which both distribute the cooling air and act to internally cool a particular component.

A continuing challenge of providing cooling passages within components is to improve the tolerance with which the passages can be placed within components so that the wall thickness of a component can be reduced so far as possible.

Typically, cooling passages can be provided by so-called lost wax method or investment casting of components as is well known in the art of casting technology. Lost wax casting involves the principal steps of forming a ceramic core, surrounding the core with a wax (or other suitable sacrificial material), prior to coating the waxed core with a ceramic shell. The core defines an internal cavity within the cast metal component, the wax defines the space in which metal will be cast, and the shell defines the external surface of the cast metal component.

The core may be injection moulded prior consolidation by drying and optionally firing. The core is then placed in a second mould and wax is injected. The wax covered core is then repeatedly dipped in ceramic slurry to provide the shell. Once the shell is dry, the wax is removed using the appropriate process as defined by the chemistry of the wax (e.g. by soaking in water for a water soluble wax, or heating) and the vacated mould fired to ready it for receiving molten metal. To cast the object, metal is poured into the cavity which has been provided by the removed wax. After the metal has solidified, the ceramic parts are removed by a leaching process to leave the cast metal component which may be further processed by machining or annealing for example.

Known problems with ceramic cores is the inevitable shrinkage and warping during the drying an firing thereof, and the wax encapsulation which may involve a high pressure injection with resultant mechanical stresses on the core parts. Thus, in any core production there will be a manufacturing tolerance which must be accommodated.

One effect of providing this tolerance is the addition of material to the walls of the cast component so as to guarantee a minimum wall thickness after any movement or shrinkage is allowed for. However, providing a minimum wall thickness may be problematic where the wall thickness needs to be as low as possible, for example, to reduce the component weight or allowing the performance of the resultant cast component as predictable as possible.

The straying of core sections away from an expected or desired position is more notable for longer core passages in which there is an accumulation of error along the length of the passage and the elongate geometry results in an inherently more flexible structure which is less able to withstand the wax injection or subsequent processing steps without drifting from the required position.

The movement of sections of a core is most notable when a relatively long core section is tortuous such that the passage length between two points is significantly greater than the direct separation between the two points. Thus, the movement accumulated over the length is presented across a smaller separation.

One way to combat relative movement between core passages is to use so-called core ties which extend between adjacent core passages and provide some stability. These core ties may be ceramic, and thus form part of the cooling passage once the ceramic has been removed. This leads to the addition of a potentially unwanted cooling path joining adjacent passages which short circuits some of cooling circuit.

Another method of providing core stability is to use metallic core ties which are subsumed into the cast metal part due to the relative melting point of the ties and liquid metal used to cast the part.

Both of these methods are suitable for particular core passage geometries, but are lacking for others. The present invention seeks to provide an improved method of tying core passages together.

This invention seeks to provide an improved core structure and method of casting a component which allows for more accurate placement of the cooling passages to allow for improved components with more predictable cooling properties and the potential for reducing the wall thickness of component.

STATEMENTS OF INVENTION

The present invention provides a core according to the appended claims.

Thus, below there is described a core for an investment casting process in which a component to be cast has an internal passageway and an exterior wall, the internal passageway being provided by the core, the core comprising: a core passage which extends between a first point and a second point along a tortuous path having length L, wherein the first point and second point are separated by a direct line of sight distance, S, wherein L is greater than S; and, characterised by: a core bridge which extends away from the core passage between the first and second points, wherein the core bridge comprises first and second pillars which connect to the first and second points, and a bridge portion which extends between the first and second pillars.

The core passage may include a first path extending away from the first point, a second path extending away from the second point, the first path and second path joining at a return, wherein the return is the furthest distance, M, from the first and second paths.

The return may be a u-bend. The return may turn the direction of the passage back towards either or both of the first or second points. The U-bend may turn the direction of the passage through 180 degrees. The first and second paths may be straight.

The first and second pillars may extend away from the core passage in a perpendicular direction relative to the connecting interface at either or both of the first and second points.

The first and second pillars may extend away from the core passage in a common direction. The common direction may be defined by the longitudinal axis of each pillar. Alternatively, or additionally, the common direction may be defined as being towards an exterior wall region of the core. The exterior wall region of the core will be defined by component cast from the core and or when the core is surrounded by a sacrificial layer such as wax.

The core passage may lies within a plane (P) and the core bridge extends out of that plane. The common plane may be curved. The plane may be defined by the first and second connection points and the portion of the core passage which is furthest from the first and second connection points.

The core may comprise a ceramic material. The core may further comprise an outer layer of a sacrificial material. The outer surface of the sacrificial material may define the interior surface of an externally facing wall of a cast component. The sacrificial material may be wax based. The core may further comprising a ceramic shell. The ceramic shell may encapsulate the sacrificial layer and provide a containment wall for receiving a molten metal from which the cast component is made.

The core bridge extends between the core passage and the shell. The bridge portion may be fully or substantially encased within the ceramic shell. Either or both of the first and second pillars may provide an in use inlet to the core passage.

The ratio of L:S may be in the range of approximately 12:1 to approximately 400:1. The ratio L:S may be between approximately 50:1 and 80:1.

The core may be used to provide a cooling passage for a gas turbine engine. The cooling passage may have an inlet and an outlet to introduce and exhaust a flow of cooling air in use. Either or both of the inlet and outlet may be provided by the connection of the first and second pillars at the first and second points.

The core may be used to provide a cast component. The cast component may be component for a gas turbine engine. The component may be an air cooled component having at least one cooling passage for a flow of air provided by the core. The component may be a seal segment which bounds a portion of the main gas path of the gas turbine engine.

Also described is a core for an investment casting process, comprising: a core passage including a first point and a second point which are separated by a direct line of sight distance, S, wherein a first path extends away from the first point, a second path extends away from the second point, the first path and second path joining at a return, wherein the return is the furthest distance, M, from the first and second paths; and, a core bridge which extends between the first and second points away from the core passage.

The ratio of M:S is between approximately 6:1 and 200:1. The ratio M:S may be between approximately 25:1 and 40:1.

A component using the core of the invention can be cast using a method, comprising:

providing a ceramic shell comprising: a core comprising: a core passage which extends between a first point and a second point along a tortuous path having length L, wherein the first point and second point are separated by a direct line of sight distance, S, wherein L is greater than S; and, a core bridge which extends away from the core passage between the first and second points, wherein the core bridge comprises first and second pillars which connect to the first and second points, and a bridge portion which extends between the first and second pillars and an outer layer of a sacrificial material enveloping the core, wherein the core bridge extends between the core passage and the ceramic shell through the sacrificial material and a portion of the bridge is located within the ceramic shell; removing the sacrificial material; pouring molten metal into a cavity created by the removal of the sacrificial material.

The core may be injection moulded from a ceramic material prior to solidification and drying.

The method may further comprise removing the ceramic shell and core, wherein the first point is provided as an aperture for the passageway within the component and the second point is sealed over with a cap.

DESCRIPTION OF DRAWINGS

Embodiments of the invention will now be described with the aid of the following drawings of which.

DETAILED DESCRIPTION OF INVENTION

Figure 1:
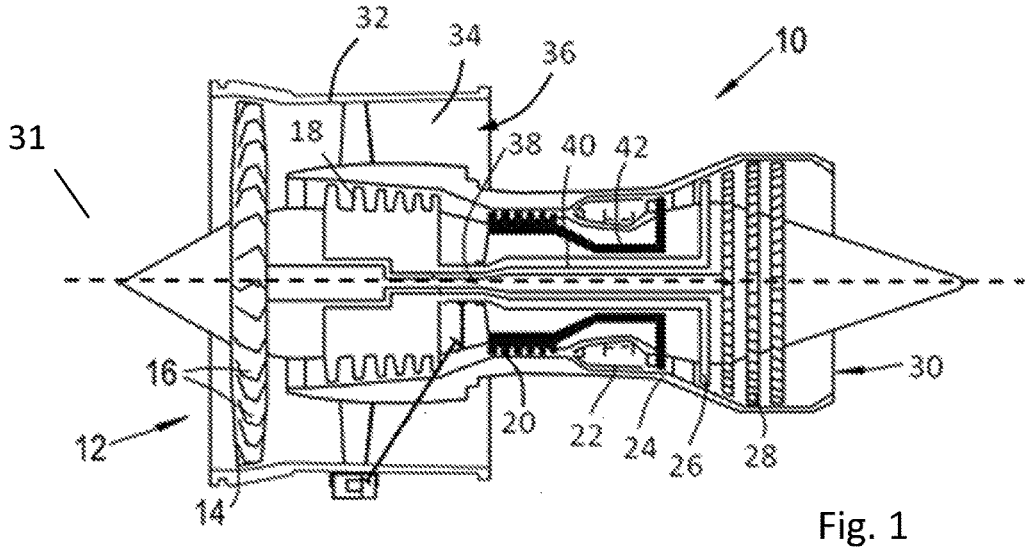
FIG. 1 shows a conventional gas turbine engine known in the art and as previously described above.
Figure 2:
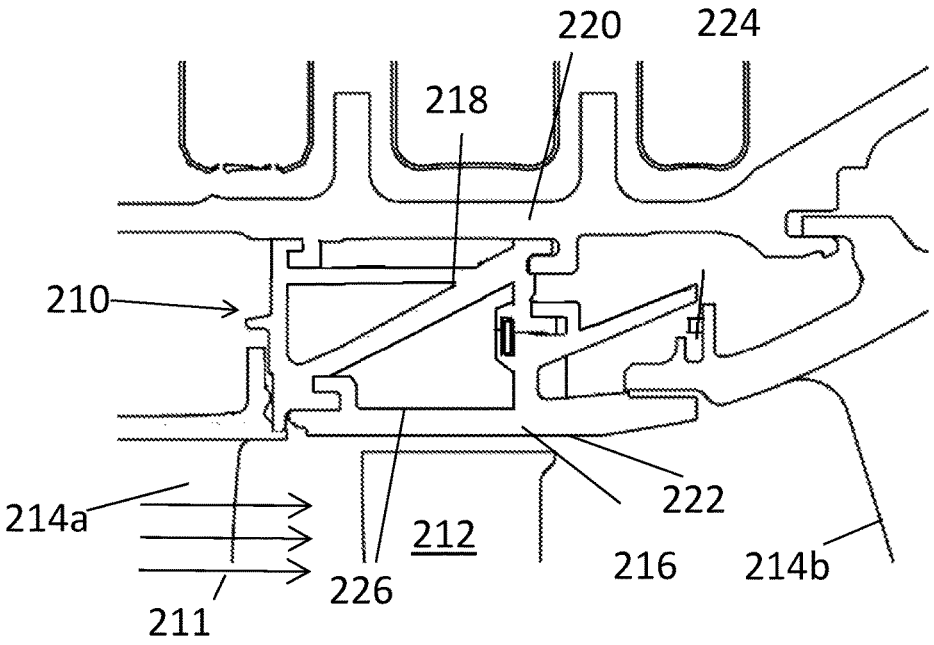
FIG. 2 shows a partial section of a high pressure turbine stage of a gas turbine engine.

FIG. 2 provides a cross-section of the static shroud arrangement 210 and surrounding structure which can be located within the architecture of a substantially conventional gas turbine at a location as highlighted in FIG. 1.

The shroud arrangement 210 forms part of the turbine section and defines the boundary of the hot gas flow path 211 thereby helping to prevent gas leakage and provide thermal shielding for the outboard structures of the turbine section.

The turbine (rotor) blade 212 sits radially inwards of the shroud arrangement 210 and is one of a plurality conventional radially extending blades which are arranged circumferentially around a supporting disc (not shown) which is rotatable about the principal axis 31 of the engine. Corresponding arrays of nozzle guide vanes 214*a*, 214*b*, NGVs, are axially offset from the rotor blades 212 with respect to the principal axis 31 of the engine and alter the direction of the upstream gas flow such that it is incident on the rotor blades 212 at an optimum angle. Thus, the turbine generally consists of an axial series of NGV 214*a* and rotor blade 212 pairs arranged along the gas flow path 211 of the turbine, with different pairs being associated with each of the high pressure turbine, HPT, intermediate pressure turbine, IPT, and low pressure turbine, LPT.

The shroud arrangement 210 shown in FIG. 2 principally includes three main parts: a seal segment 216, a carrier 218 and an engine casing 220 which sit in radial series outside of the main gas path 211 and rotor blade 212. The shroud arrangement 210 of the embodiment is that of an HPT, but the invention may be applied to other areas of the turbine, or indeed other areas of the turbine or non-turbine applications where appropriate.

The seal segment 216 includes a plate 222 having an inboard gas path facing surface 224 and an outboard surface 226 which is provided by the radially outward surfaces of the plate 222 relative to the principal axis 31 of the engine. The seal segment 216 is one of an array of similar segments which are linked so as to provide an annular shroud which resides immediately radially outwards of the turbine rotor blades 212 and defines the radially outer wall of the main gas flow path 211. Thus, the seal segment 216 shown is one of a plurality of similar arcuate segments which circumferentially abut one another to provide a substantially continuous protective structure around the rotor blade 212 tip path.

The seal segment 216 is fixed to the engine casing 220 via a corresponding carrier segment 218. The carrier segment 218 is one of a plurality of segments which join end to end circumferentially to provide an annular structure which is coaxial with the principal axis 31 of the engine. The engine casing 220 is a full annular housing which sits outboard of the carrier 218 and generally provides structural support and containment for the turbine components, including providing direct support for the shroud cassette which comprises the seal segment and carrier 218.

The seal segment 216 is contacted by the hot gas flow through the turbine and thus requires cooling air. The choice of cooling air source is largely dictated by the required reduction in temperature at a particular location and the expected working pressure the cooling air exhausts into.

The cooling air can be provided from any suitable source but is typically provided in the form of bleed air from one or more compressor stages. Thus, air is bled from the compressor and passed through various air cooling circuits both internally and externally of the components to provide the desired level of cooling.

To provide suitable cooling to the seal segment, internal passageways are provided in the plate 222 which channel cooling air through the component prior to being exhausted ultimately into the main gas path.

Figure 3:
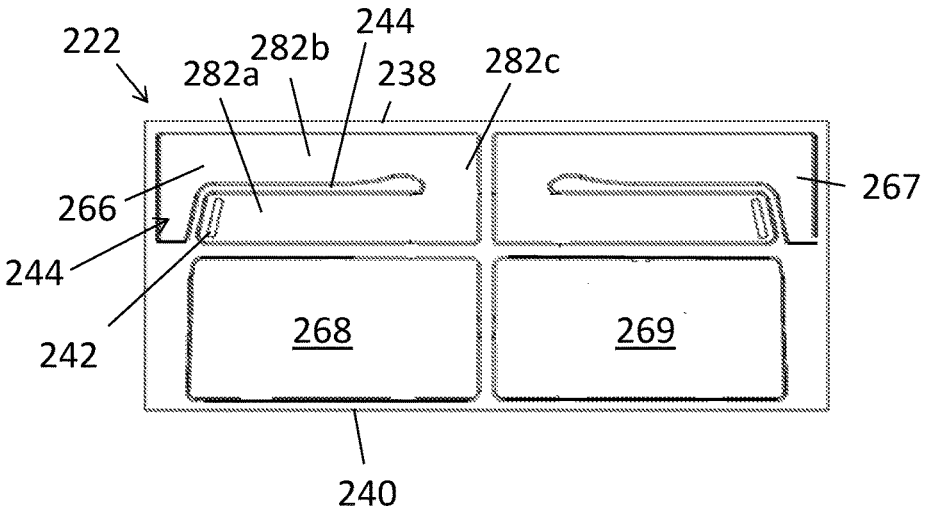
FIG. 3 shows a circumferential section of a component having internal cooling apertures of a turbine component for a gas turbine component.

FIG. 3 shows a schematic radially facing circumferential section of the interior of the seal segment plate 222 and the internal network of passages which channel the cooling air. The sealing segment plate 222 is constructed from two radially separated external walls which provide the radially inner 224 and outer 226 surfaces of the seal segment 216 and has a leading or upstream edge 238 and a trailing or downstream edge 240 relative to the direction of the main gas path. The space between these walls and within the plate 222 is approximately divided into four quadrants which provide four fluidically isolated cooled portions, 266, 267, 268, 269.

The first (and second 267) cooling circuit 266 is provided by a meandering passage in the form of a U shape having two straight portions 282*a,b* connected by a sharp bend 282*c* which reverses the trajectory of the coolant. The straight portions 282*a,b* are substantially parallel to one another and generally traverse the plate 222 circumferentially (or laterally) so as to extend between the circumferential edges towards the mid-line of the plate where the bent portion 282*c* is located. One of the straight portions 282*b* is an outlet leg and is located aft of and defined by a wall which provides the leading edge 238 of the plate 222. The other straight portion 282*a* extends from an inlet 242 which is provided by an elongate aperture located in the radially outboard wall of the plate 222, so as to be fluidically connected to the cooling air plenum located above. The two straight legs are separated by a continuous solid wall 244 therebetween.

A convergent exhaust 246 is located at a downstream end of the outlet leg 282*b* and extends along the circumferential edge of the plate 222 from the leading edge 238 towards the trailing edge 240.

The first cooling circuit 266 arrangement described in FIG. 3 provides a similar configuration as may potentially be found in many cast component architectures, in that there is a passage which extends between a first point and a second point along a tortuous path. The first point and second point are separated by a direct line of sight distance S with the tortuous path having length L.

Having this arrangement can be problematic when L is significantly greater than S due to the internal stresses within the core material and the resultant warping and out-of-plane separation of the adjacent points. That is, the length of the core compared with the relative separation at the ends may result in an unpredictable plus or minus warping in the out-of-plane direction during the fabrication of the core. The warping will be dependent on numerous factors including the specific geometry, the core material and core manufacture and process. However, it is a reasonable assumption that the amount of distortion can be crudely associated with the unsupported length of the passage.

Warping may be tolerable if the ends or adjacent or proximate parts of the passageways are well separated from one another because the distortion of the passageway may be accounted for within the component. However, where the cooling passage is tortuous and has portions which pass close to one another along its length, the distortion is more readily notable and problematic.

Thus, for a passage length of, for example, 70 mm the out-of-plane distortion between two points may be 300 microns or greater using current casting techniques. If the two parts of the cooling passage are adjacent one another, within a few millimeters, then the out-of-plane separation is more difficult to tolerate and will affect the overall wall thickness which must accommodate the mismatch. In other words, the wall thickness will need to be greater so that a minimum wall thickness can be maintained.

Figure 4:
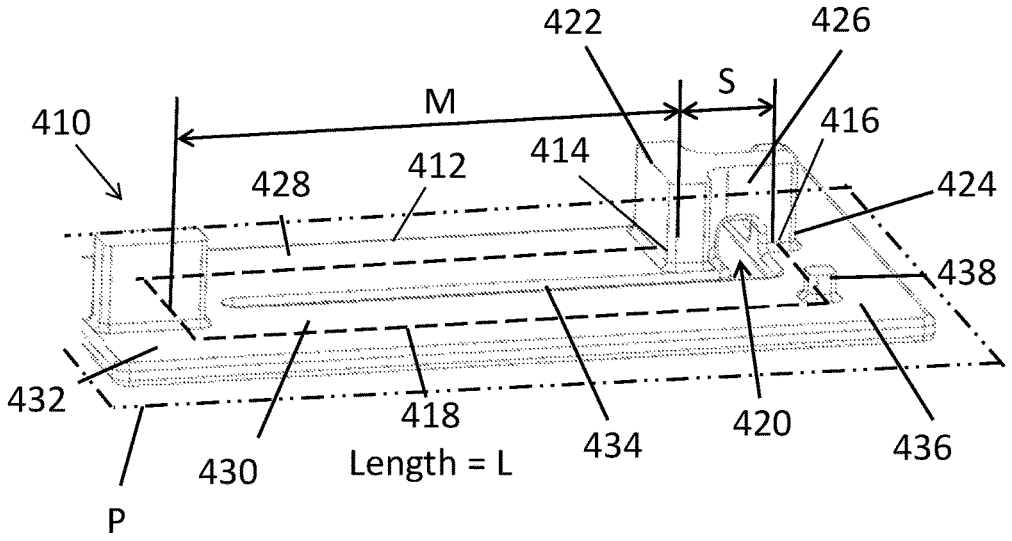
FIG. 4 shows of a ceramic core which could be used to cast a part similar to that shown in FIG. 3.

FIG. 4 shows a section of core 410 which is used in an investment casting process to provide a cooling passage similar to the first cooling circuit 266 shown in FIG. 3. Thus, very generally, the core 410 is a moulded from a ceramic material which is subsequently coated in wax prior to being encased in a ceramic shell. The wax is then removed and molten metal poured into the ceramic shell and the vacancy left by the wax. The core and shell are then removed to provide a hollow metal cast part with a cooling passage in the shape of core 410.

The core passage 412 extends from a first point 414 to a second point 416 along a tortuous path 418 in which the first point 414 and second point 416 are separated by a direct line of sight distance S and the tortuous path has a length L. As can be seen L is far greater than S. Thus, there is a core passage 412 which extends to a maximum distance M from the first 414 and second 416 points and the distance S between the first 414 and second 416 points is shorter than that maximum distance M. S may be in the approximate range of between 0.5 mm to 3 mm. Typically, the range may be somewhere between 0.5 and 1.5 mm. M may be in the approximate range of between 20 mm and 100 mm, but will typically be a maximum of around 50 mm. The ratio of M:S will be between approximately 6:1 and 200:1, with some examples being between 25:1 and 40:1. L will have ranges and ratios of approximately twice M.

The arrangement includes a core bridge 420 which extends between and defines the first 414 and second 416 points. In the described example, the first point 414 and second point 416 are located at adjacent or proximate positions along the length of the path 418, with the first location at a first end of the path which corresponds to an inlet of the cooling passage in the cast component, and the second point is local to a second end which corresponds to an outlet or exhaust in the cast component. However, it will be appreciated that the relative position of the first and second points with respect to the length of the core passage, and the span of the bridge 420, may vary. There may also be additional points which are interconnected by a single bridge or multiple bridges.

Figure 5:
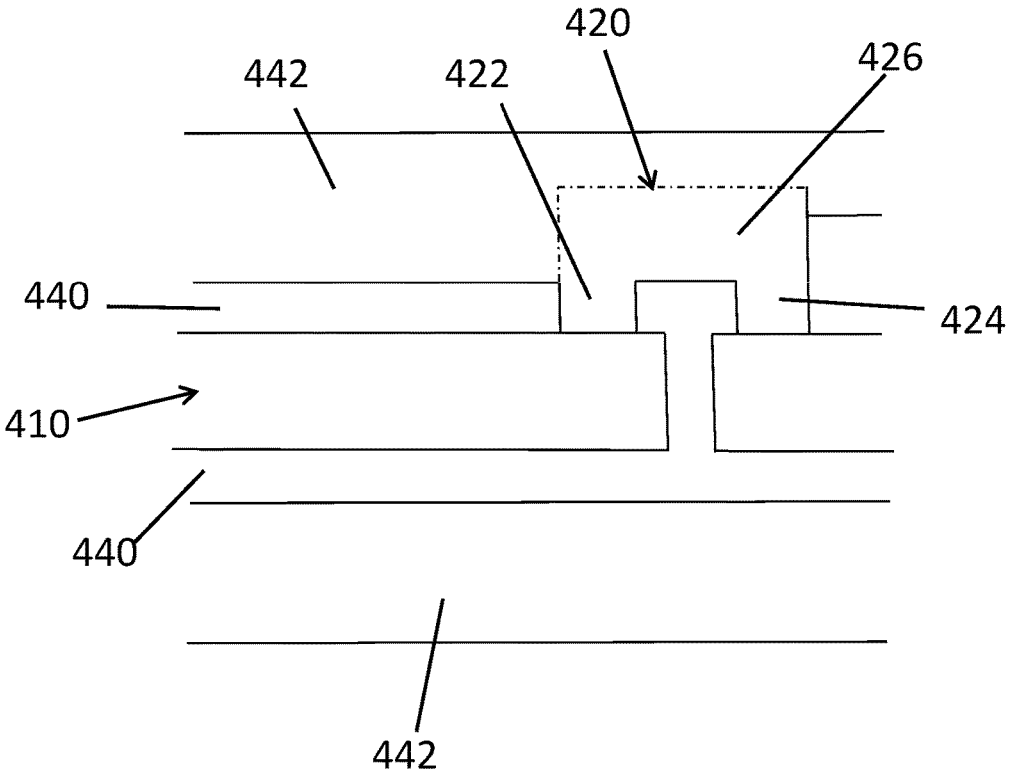
FIG. 5 shows a core including a wax layer and a ceramic shell.
Figure 6:
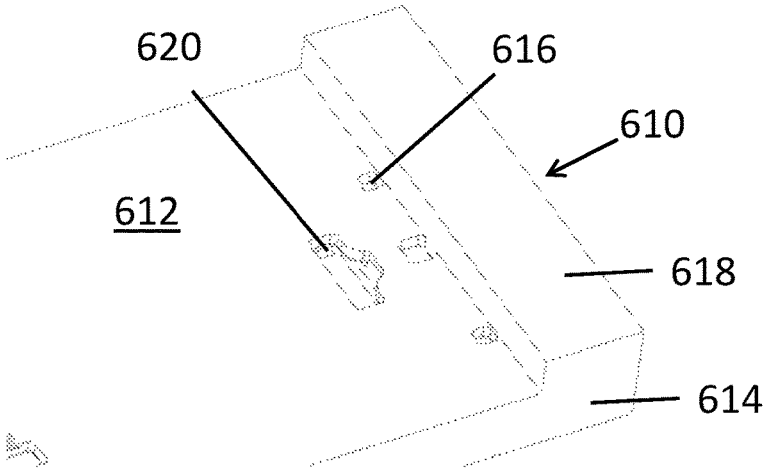
FIG. 6 shows a cast component

As best seen in FIG. 5 and described further below, the core bridge 420 extends away from the core passage 412 such that it can pass through the sacrificial layer, e.g. wax, once applied, and connect with the ceramic shell. In doing so, the core bridge extends away from the core passage, through the component wall once cast, so as to leave a hole in an exterior facing surface. Such holes are shown in FIG. 6 and described below.

In the described example of FIG. 4, the core passage 412 is generally planar and so the core bridge 420 can be thought of as extending out of the plane defined by the core passage 412. It will be appreciated of course that the plane is a circumferential plane in the described example of a seal segment due to it forming part of an annular wall, and is therefore curved. Hence, the core bridge 420 extends out relative to the tangential plane in the immediate vicinity of the first and second points. However, it will also be appreciated that a core passage may extend along a curved or stepped path having different radii of curvature and relative height levels in which a satisfactory definition of a plane cannot be obtained. In such cases, the core bridge 420 can be considered to be projecting away from the core passage into an exterior wall portion adjacent the first and second points. As such, the core bridge does not extend across the space between opposing sides of the core passage which would define a partitioning wall and segregates the cooling passages in the cast component.

The core bridge 420 includes two pillars 422, 424 and a bridging portion 426. The proximal ends of the pillars 422, 424 which interface with the core passage 412 provide the respective first 414 and second 416 points. In the example, the interface between the core passage 412 and the pillars 422, 424 is on the upper surface of the core which defines the exterior wall of the component and the pillars extend away from the respective faces in a perpendicular direction away from the core passage towards the exterior wall.

The core passage 412 includes two legs 428, 430 which extend generally away from the core bridge and meet at a return 432 in the form of a U-bend. The two leg portions 428, 430 are straight and lie in a parallel relation in a common plane. They are separated by a continuous uninterrupted partition 434 in the form of a space which provides a cavity for an internal wall within the component during casting. The partition is uninterrupted in so much that it is not bridged by any core ties or other features. As such, the legs are separate between the first and second points and the maximum point.

The core passage 412 includes a further bend 436 between the U-bend and second point 430 which turns the path 418 around the end of the first point so as to form an elongated spiral or e-shaped structure. Thus, the core passage 412 includes portions which extend parallel to and transverse to a first axis which, in the described example is the major or longitudinal axis of the core 410 as a whole.

It will be appreciated that the core passage 412 may include additional features which aid heat transfer in the cooling passage of the component, such as recesses (not shown) to provide pedestals or trip strips. Further, the cooling passage 412 may include one or more core ties to provide additional support or a particular interconnecting flow between the core passages, if required.

The first pillar 422 is polygonal in transverse section and in the form of a rectangle. The second pillar 424 is also polygonal but in the form of a square. The pillars 422, 424 are connected by a bridge portion 426 which includes distal and proximal surfaces relative to the first 414 and second 416 points. The proximal surface is spaced from the core passage 412 so as to provide a clear out-of-plane separation therefrom. The extent of the separation corresponds to and provides the thickness of the associated exterior wall portion of the finally cast component. Thus, the first 422 and second 424 pillars provide the through-hole in the exterior wall of the component, with the bridge being subsumed within the ceramic shell.

The second pillar 424 is in perpendicular alignment with the approximate mid-line portion of the major axis of the first pillar 422. The bridge 426 extends between opposing flanks of the first 422 and second 424 pillars. The width of the bridge is approximately the same as the corresponding width of the second pillar so as to provide a flush interface. Thus, the combined first pillar 422, bridge 426 and second pillar 422 are generally T-shaped in transverse section. The depth of the bridge portion 426 is greater than the width which aids the rigidity of the connection for the subsequent wax injection step.

It will be appreciated that other configurations of core bridge may be possible. For example, the pillars may be oval in section, or the major axis may be inclined relative to the bridge such as would be the case for the inlet provided in the arrangement shown in FIG. 3.

The core shown in FIG. 4 includes other ancillary features. The first of these is a projection 438 or via in the form of a stump which provides a through-hole in the wall of the cast component. The though-hole is used for inspection purposes such that the relative positions of the cooling passage 412 local to the first and second positions can be validated. The second ancillary feature is an additional projection located at the maximum distance along the passage from the first or second points, and thus on the return in the described example. This optional feature may be used to hold the core during wax injection to provide further stability and or an additional inlet to the cooling passage.

It will be appreciated that, due to the flat geometry of the core passage 412, the length of the path 418 may be defined in different ways. For example, the length could be defined by the shortest connecting wall between the first and second points, or the longest wall provided it is part of the same core passage. A suitable general definition of the length L of the path 418 for the purpose of understanding the invention may be defined as the mean length of the core passage between the first and second points as approximately shown by the dotted line in FIG. 4. The mean length in this instance is the mean of the length of the path which extends along the longitudinal midline of the passage.

FIG. 5 shows a schematic radial section of a core 410 similar to that of FIG. 4. However, the core 410 is shown subsequent to being encapsulated with wax 440 and the ceramic shell 442. Thus, there is a core passage 412, the first 422 and second 424 pillars and bridge portion 426 of the core bridge 420, a wax layer 440 which encapsulates the core and defines the exterior wall of the cast component, and the ceramic shell 442. As can be seen, the upper extents of the pillars 422, 424 and the bridge portion 426 reside within the ceramic shell 442. The lower portions of the pillars extend through the wax so as to connect the core passage and ceramic shell 442.

FIG. 6 shows the exterior of a cast component 610 which has been made using the core of FIG. 4. Thus, there can be seen the outer upper wall 612 and a side wall 614, with the holes provided by the removal of the core bridge 426, specifically the first and second pillars which projected through the core. Also shown is the core inspection ports 616 provided by the ancillary stumps.

A thicker wall portion 618 is provided on the outer surface for reinforcing the component and/or providing a blank from which features may be machined.

Figure 7:
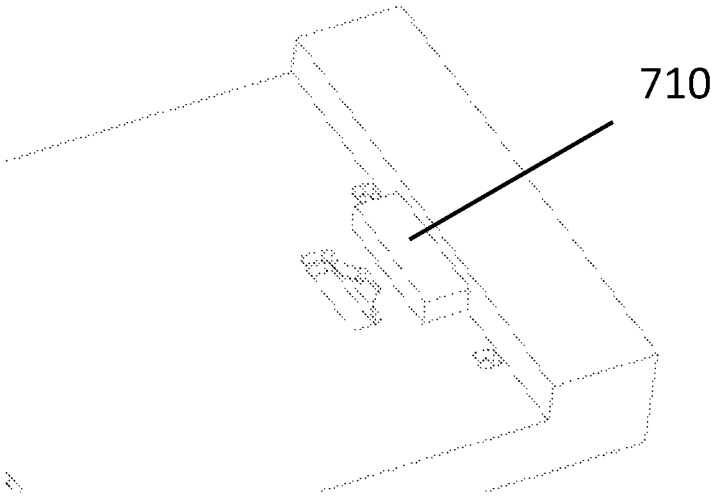
FIG. 7 shows a cast component having capped a core bridge hole.

The hole 620 provided by the first point corresponds to an inlet for the flow of cooling air in the component when in use. The aperture left by the second pillar is unwanted and would represent a leak of cooling air in use. Thus, as shown in FIG. 7, this aperture is sealed over with a cap 720 which is provided by an appropriate method such as welding. Although not shown, the inspection apertures may be sealed over in a similar fashion. The outlet flow passages are to be provided on the lateral flank which is obscured from view by a later machining step.

It will be understood that the invention is not limited to the described embodiments and various modifications and improvements can be made within the scope of the claims. Except where mutually exclusive, any of the features may be employed separately or in combination with any other features and the disclosure extends to and includes all combinations and sub-combinations of one or more features described herein.

The invention claimed is:

1. A core for an investment casting process in which a component to be cast has an internal passageway and an exterior wall, the internal passageway being provided by the core, the core comprising:

a core passage which extends between a first point and a second point along a tortuous path having length L, wherein the first point and second point are separated by a direct line of sight distance, S, wherein L is greater than S; and, a core bridge which extends away from the core passage between the first and second points, wherein the core bridge comprises first and second pillars which connect to the first and second points, and a bridge portion which extends between the first and second pillars.

2. A core as claimed in claim 1, wherein the core passage includes a first path extending away from the first point, a second path extending away from the second point, the first path and second path joining at a return, wherein the return is the furthest distance, M, from the first and second points.

3. A core as claimed in claim 2, wherein the return is a u-bend.

4. A core as claimed in claim 1, wherein the first and second paths are straight.

5. A core as claimed in claim 1, wherein the first and second pillars extend away from the core passage in a perpendicular direction relative to the connecting interface at either or both of the first and second points.

6. A core as claimed in claim 5, wherein the first and second pillars extend away from the core passage in a common direction.

7. A core as claimed in claim 1, wherein the core passage lies within a plane and the core bridge extends out of that plane.

8. A core as claimed in claim 1, wherein the core comprises a ceramic material.

9. A core as claimed in claim 1, wherein the ratio of L:S is in the range of approximately 12:1 to approximately 400:1.

10. A core as claimed in claim 1 in which the core passage and core bridge are formed as a homogenous body.

11. A ceramic shell for an investment casting process in which a component to be cast has an internal passageway and an exterior wall, the internal passageway being provided by a core, the ceramic shell comprising:

a core comprising:

a core passage which extends between a first point and a second point along a tortuous path having length L, wherein the first point and second point are separated by a direct line of sight distance, S, wherein L is greater than S; and, a core bridge which extends away from the core passage between the first and second points, wherein the core bridge comprises first and second pillars which connect to the first and second points, and a bridge portion which extends between the first and second pillars, an outer layer of a sacrificial material enveloping the core, wherein the core bridge extends between the core passage and the ceramic shell through the sacrificial material and a portion of the bridge is located within the ceramic shell.

12. A ceramic shell as claimed in claim 11, wherein the substantially all of the bridge is located within the ceramic shell.

* * * * *